United States Patent [19]

Passovoy

[11] 4,369,600

[45] Jan. 25, 1983

[54] DOOR FRAME ASSEMBLY WITH IMPROVED CHARACTERISTICS

[76] Inventor: Alexander E. Passovoy, 241 Village Gate Rd., Orinda, Calif. 94563

[21] Appl. No.: 263,534

[22] Filed: May 14, 1981

[51] Int. Cl.[3] ..... E06B 1/04

[52] U.S. Cl. ..... 49/504

[58] Field of Search ..... 49/504, 505, 501

[56] References Cited

U.S. PATENT DOCUMENTS

| | | | |
|---|---|---|---|
| 3,287,856 | 11/1966 | Passovoy | 49/504 |
| 3,299,592 | 1/1967 | Cable | 49/504 X |
| 3,545,135 | 12/1970 | Lieber | 49/505 |
| 3,774,345 | 11/1973 | Cole et al. | 49/504 |
| 3,783,559 | 1/1974 | Yocum et al. | 49/504 |
| 3,964,214 | 6/1976 | Wendt | 49/504 X |
| 4,034,514 | 7/1977 | Cecil | 49/504 |
| 4,236,354 | 12/1980 | Passovoy | 49/504 |

*Primary Examiner*—Philip C. Kannan

*Attorney, Agent, or Firm*—Townsend and Townsend

[57] ABSTRACT

The present invention is a prefabricated door frame assembly with improved characteristics which includes a frame member formed of a web with flanges extending from its lateral edges. The web includes a pair of grooves opening in a common transverse direction, one groove located near the center of the web and the other groove located proximate one lateral edge of the web, and a longitudinally extending recess between the grooves. In combination with the web, the assembly includes at least two hinge members, each having a hinge plate including a set of elongate tongues adapted to engage and mate with the respective grooves in the frame member and a separate elongate tongue projecting normal to the other tongues into the recess of the frame member. Also included are at least two bars slidable in the recess of the frame member, each bar defining a longitudinally extending slot on its outer surface to engage the separate elongate tongue of its respective hinge member. Usually, the assembly includes a strike plate having elongate tongues similar to those of the hinge plates and a third such bar to engage the separate elongate tongue of the strike plate.

12 Claims, 6 Drawing Figures

DOOR FRAME ASSEMBLY WITH IMPROVED CHARACTERISTICS

BACKGROUND OF THE INVENTION

1. Field of the Invention

The present invention relates to door frame assemblies, and particularly to prefabricated door frame assemblies.

2. Summary of the Prior Art

The use of prefabricated metal door frames has become quit common in both interior and exterior building construction and various different types of prefabricated frames and frame assemblies have been developed and used over the years. One of the more common types of prefabricated frames includes a frame member (which includes a web spanning the door opening in the wall and flanges extending from the edges of the web to circumscribe the opening) plus separate hinges and strike plates attached to the frame by conventional screw fasteners. Serious disadvantages of this type of prefabricated frame, however, are the necessity of cutting the frame at the construction site to install the hinge plates and strike plate and the subsequent manual labor required to insert the numerous screw fasteners attaching the hinges and strike plates to the frame.

Other prefabricated door frames have been developed which avoid some of these problems but which have other disadvantages. In a frame such as that described in Cable, U.S. Pat. No. 3,299,592, the necessity of cutting the frame to install the hinges is avoided by providing countersunk areas or slots in the frame to which the hinges are spot welded. However, in the Cable frame, the hinges thus must be attached to the frame at the preset countersunk or slotted locations, preventing the convenient use of pre-mortised doors which may or may not have appropriately located hinges. In addition, the addition of preset locations for the hinges requires the production of different models of the frame for left and right swinging doors.

In prefabricated door frame assemblies such as that depicted in Passovoy, U.S. Pat. No. 3,287,856, the hinge assembly includes a frame member to which the hinges and strike plates can be attached at any location plus cover plates attachable to the incomplete frame member to "finish" it where the hinges and strike plates are not attached. Although this assembly allows the use of pre-mortised doors, the use of conventional screw fasteners to attach the hinges and strike plates still requires considerable manual labor. A similar problem is encountered with the prefabricated door frame assembly described in Yocum, et al., U.S. Pat. No. 3,783,559, and Cole, U.S. Pat. No. 3,774,345. The Yocum assembly in fact requires even more manual labor for installation because the cover plates too are attached by screw fasteners.

The prefabricated door frame assembly depicted in Passovoy, U.S. Pat. No. 4,236,354, issued Dec. 2, 1980, minimizes the manual labor involved in installation of the assembly and allows the use of pre-mortised doors but has other disadvantages. This assembly includes frame members having two transversely aligned parallel serrated slots to which prefabricated hinges having parallel serrated projecting tongues engageable with the slots are attached by inserting the tongues in the slots in the frame member. Similarly attachable cover plate sections and strike plates are also included. A problem with the Passovoy assembly, however, is that the hinge plates as well as any strike plates included may tend to detach from the frame member, the tongues sliding out of the slots under stress. In addition the hinge plates and strike plates may tend to rattle, giving the door frame undesirable noisy characteristics.

SUMMARY OF THE INVENTION

The present invention is a prefabricated door frame assembly with improved characteristics which includes a frame member formed of a web with flanges extending from its lateral edges. The web includes a pair of grooves opening in a common transverse direction, one groove located near the center of the web and the other groove located proximate one lateral edge of the web, and a longitudinally extending recess between the grooves. In combination with the web, the assembly includes at least two hinge members, each having a hinge plate including a set of elongate tongues adapted to engage and mate with the respective grooves in the frame member and a separate elongate tongue projecting normal to the other tongues into the recess of the frame member. Also included are at least two bars slidable in the recess of the frame member, each defining a longitudinally-extending slot on its outer surface to engage the separate elongate tongue of its respective hinge member. Usually, the assembly includes a strike plate having elongate tongues similar to those of the hinge plate and another bar to engage the separate elongate tongue of the strike plate.

Preferably, the web of the frame member is designed to include a planar section extending from one lateral edge to approximately the center of the web, which terminates in the first transversely opening groove, and the second transversely opening groove is located proximate the second lateral edge and parallel to the first groove but offset therefrom toward the wall. Also, preferably, the inner wall of the recess defines a longitudinally-extending indentation at a location beneath the slot in the bar to ease insertion of a fastener extending through the bar into the frame member.

In one embodiment, the side walls of the recess in the frame member define longitudinally extending apertures therein and the sides of the bar include elongate tongues adapted to engage and mate with the apertures in the frame member to promote mating of the bar with the frame member. In another embodiment, the bar is bent longitudinally and outwardly, sufficient to exert outward pressure on a hinge plate or strike plate installed above it on the frame member, to minimize rattling of the hinge or strike plate.

The present invention provides significant advantages over prior door frame assemblies. The use of tongues on the hinge and strike plates normal to the tongues attaching the plates to the frame member, and engaging the slot in a bar inserted in the recess of the frame member minimizes the possibility of detachment of the plates from the frame member; otherwise the remaining tongues of the plates, which extend in a common direction, tend to slide out of their respective grooves under stress. The present assembly, however, still provides many of the advantages of prior assemblies, allowing the use of prehinged doors and obviating the considerable manual labor involved in installing numerous conventional screw fasteners. Furthermore, a single assembly can be used for the installation of both left and right swinging doors.

When the bars include elongate tongues extending from their sides to mate with apertures in the side walls of the recess of the frame member, an even sturdier assembly is provided. When the bars are outwardly bent to exert outward pressure on the hinge plates and strike plates, the assembly significantly minimizes rattling tendencies of the hinge plates and strike plates to provide a quiet, sturdy and aesthetically pleasing door frame assembly.

DETAILED DESCRIPTION OF THE SPECIFIC EMBODIMENTS

Figure 1:
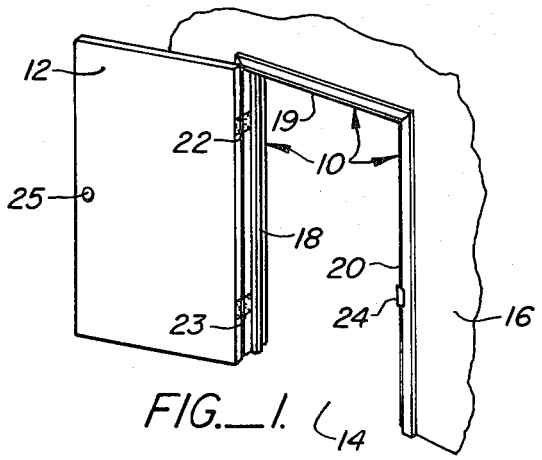
FIG. 1 is a perspective view of a door installed using a door frame assembly of the present invention.

Referring to FIG. 1, the use of the door frame assembly 10 of the present invention to install a door 12 in the opening 14 formed in a wall 16 is illustrated generally. Door frame assembly 10 includes three frame members 18–20 covering the sides and top of door opening 14. A pair of hinges 22, 23 are attached to frame member 18 so that door 12 is a right-swinging door. A strike plate 24 adapted to engage a latch actuated by knob 26 is attached to frame member 20 at the opposite side of opening 14 from frame member 18.

Figure 2:
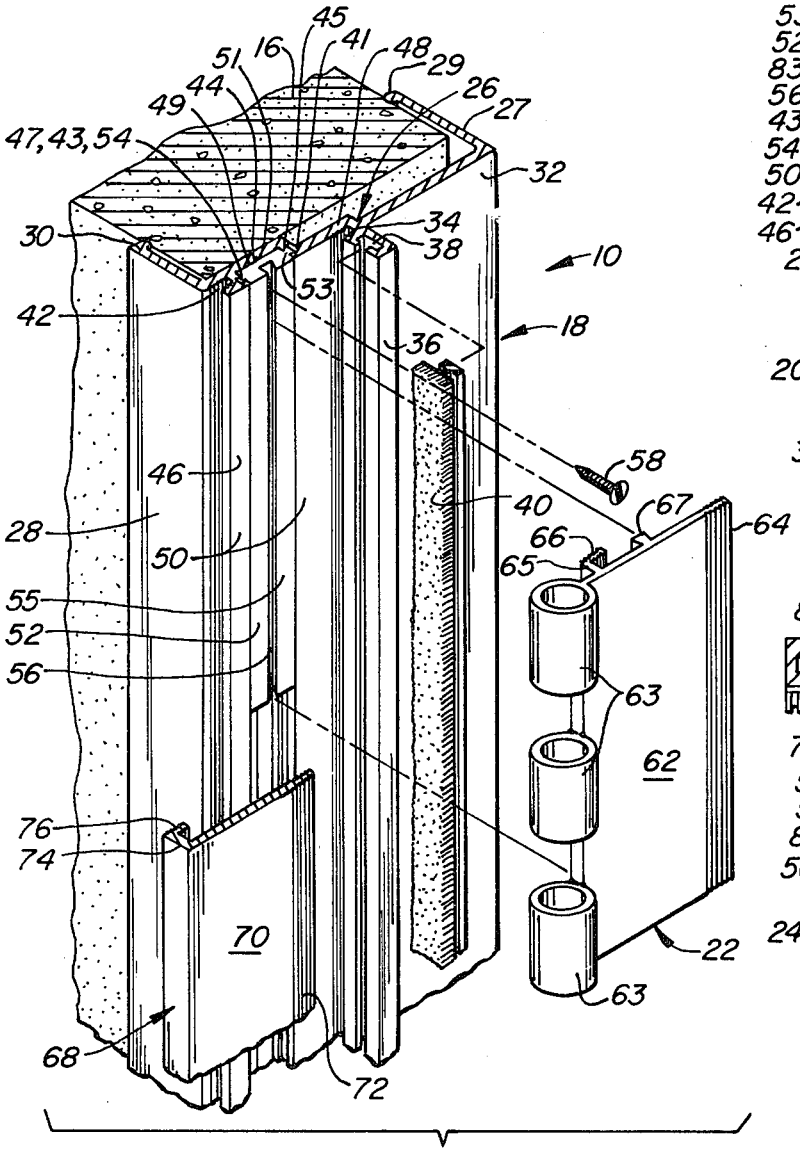
FIG. 2 is a fragmentary exploded perspective view of one embodiment of the present invention showing installation of the hinges, a bar and the cover plate.
Figure 3:
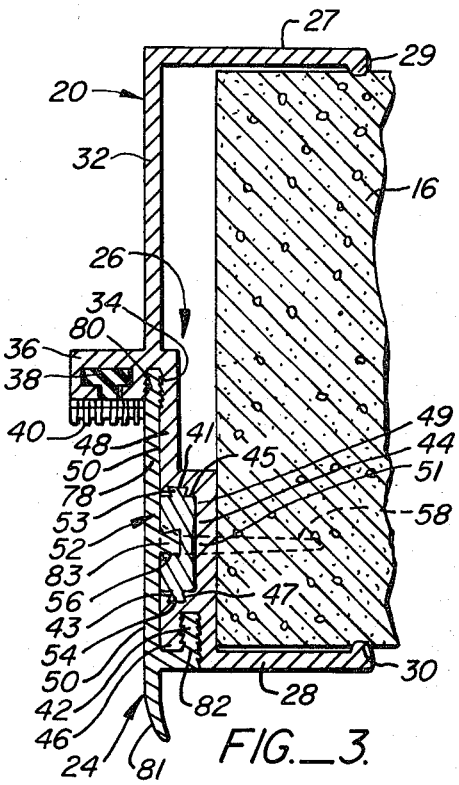
FIG. 3 is a sectional plan view of the FIG. 2 embodiment of the present invention depicting a strike plate and bar installed in the frame member.

One embodiment of door frame assembly 10 is illustrated by way of FIGS. 2 and 3; in FIG. 2, door frame member 18 is shown and in FIG. 3, door frame member 20 is shown, all of the door frame members being identical metal extrusions.

Referring specifically to FIG. 2 by way of example, the door frame member such as 18 includes a central web 26 and a pair of side flanges 27, 28. Central web 26 spans the entire width of wall 16 and side flanges 27, 28 extend around the edges of the wall. Each side flange has a projecting rib 29, 30 at its extreme end so that frame member 18 can be installed by simply snapping it over the end of wall 16.

Web 26 includes a substantially planar portion 32 extending from side flange 27 to approximately the center of the web. At the center of web 26, a transversely opening groove 34 is formed wich has a serrated configuration. Groove 34 extends along the entire length of the frame member 18 and the plane of the groove coincides with the plane of the planar portion 32 of central web 26.

A door stop abuttment 36 is provided at about the center of web 26. Door stop abuttment 36 includes a slot 38 in which a resilient door stop pad 40 can be installed. Slot 38 opens in the same direction as groove 34, i.e., opposite from the planar portion 32 of web 26, so that the door will always be located on the side of the web opposite planar portion 32.

Central web 26 also includes a second transversely opening groove 42 at the side of the web adjacent side flange 28. Groove 42 extends the entire length of frame member 18 and is serrated. The plane of groove 42 is parallel to that of groove 34 but is slightly offset toward wall 16.

As illustrated in FIGS. 2 and 3, web 26 includes a recessed portion 49 which rests against wall 16, defining recess 44 in the frame member, and a shoulder 46. Recessed portion 49 and shoulder 46 in combination define groove 42. Side walls 45, 47 of recess 44 define trapezoidal apertures 41 and 43 therein, which extend the entire length of the frame member. Inner wall 49 of recess 44 defines a centrally located identation 51, also extending the entire length of the frame member. Shoulder 46 together with a connecting portion 48 of web 26 define a planar surface 50 spaced slightly inwardly from the planar portion 32 of the web.

Bar 52 is adapted to be received in recess 44 and is slightly longer than hinge plate 22 (or hinge plate 23 or strike plate 24, as the case may be, the assembly including one bar per hinge or strike plate). Bar 52 includes elongate trapezoidal tongues 53 and 54 extending the length of the bar on its side walls which mate with apertures 41 and 43 in the side walls of recess 44 of the frame member. The outer surface 55 of bar 52 defines a trapezoidal slot 56 extending the length of the bar. Fastener 58 is included, which fastens the bar to the frame member, indentation 51 easing insertion of the fastener into the frame member.

Hinge 22 includes a hinge plate 62 adapted to attach to the frame member and bar. Hinge plate 62 has a serrated lateral edge 64 which provides a tongue adapted to project into and engage serrated groove 34 in the frame member 18. In addition, projection 65 supports an underlying serrated tongue 66 which engages serrated groove 42. The inner side of plate 62 includes an elongate projecting trapezoidal tongue 64 extending substantially normal to tongues 64 and 66 into the recess of the frame member, which engages slot 56 in bar 52.

Accordingly, after frame member 18 is installed, and bar 52 slidably inserted into recess 44 of the frame member, hinge plate 62 can readily be installed on frame member 18 (or frame members 19, 20, since they are identical) at any point along its length by snapping tongues 64 and 66 into grooves 34 and 42. Bar 52 is conveniently slid into place beneath hinge plate 22, slot 56 of the bar engaging tongue 67 of the hinge plate, and fastener 58 easily inserted through bar 52 at slot 56 and into the frame member at indentation 51 to hold bar 52 in place beneath the hinge plate on the frame member. The thickness of plate 62 and the location of projection 65 are such that when the hinge plate is installed, except for engagement rings 63, the visual appearance of the frame member 18 has mirror symmetry about a plane through its center.

A plurality of cover plate sections such as 68 are also provided. Each cover plate section 68 includes a planar portion 70 having a serrated lateral edge 72 which provides a tongue adapted to engage serrated groove 34 in frame members 18–20. The thickness of planar portion 70 is the same, or nearly the same, as that of hinge plate 62. Cover section 70 also includes a side flange 74 supporting a projecting serrated tongue 76 adapted to engage groove 42 in frame members 18–20. Accordingly, cover plate sections 68 are attached to the frame members of assembly 10 by simply snapping them into place on the frame member. The cover plate sections cover the frame member, and the fastened, extending portions of bar 52 not covered by hinge plate 62. With the cover plate sections installed, grooves 34, 42 are hidden from view, and both sides of frame member 18–20 have the same visual appearance.

The installation of strike plate 24 in frame member 20 (which is identical to frame members 18 and 19) is illustrated by way of reference to FIG. 3. Strike plate 24 includes a planar portion 78 having a serrated lateral edge 80 which engages groove 34 in frame member 20. The thickness of planar portion 78 is approximately equal to that of planar portion 70 of cover plate sections 68. Strike plate 24 also includes a curved projection 81 which accommodates the sliding latch member used to keep the door in its closed position. Strike plate 24 has an underlying serrated tongue 82 adapted to engage serrated groove 42, and a trapezoidal tongue 84 extending from planar portion 78 substantially normal to tongues 80 and 82 into the recess of the frame member, and adapted to engage slot 56 in a bar 52. In this fashion, strike plate 24 is attached to frame member 20 and a bar 52 installed in place beneath it on the frame member in the same fashion as hinge plates 62.

Figure 4:
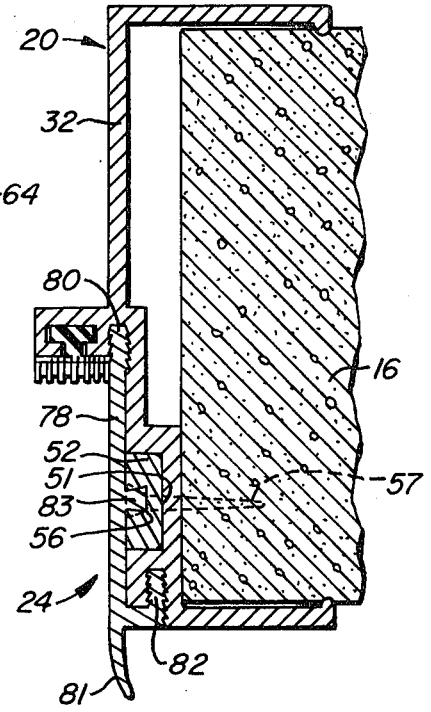
FIG. 4 is a sectional plan view of another emodiment of the present invention depicting a strike plate and bar installed in the frame member.
Figure 6:
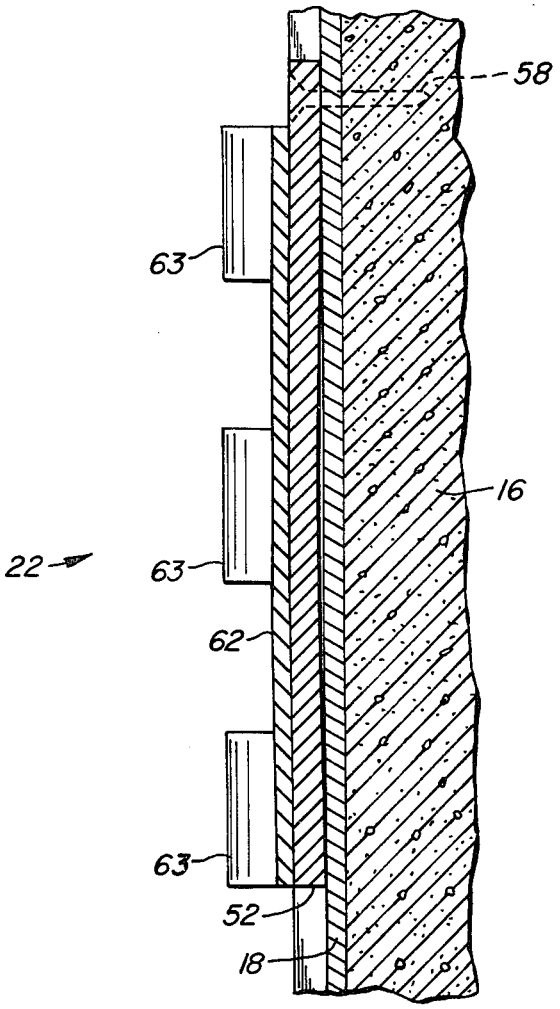
FIG. 6 is a cross-section of the FIG. 4 embodiment of the present invention taken at lines 6—6 of FIG. 5, depicting a hinge plate and bar installed in the frame member.
Figure 5:
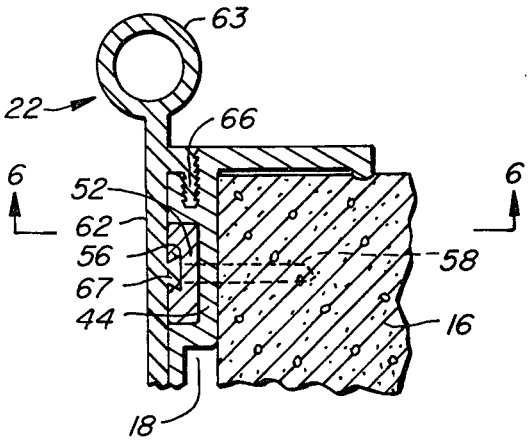
FIG. 5 is a sectional plan view of a portion of a hinge plate and a bar installed in the frame member in the FIG. 4 embodiment of the present invention.

Another embodiment of the present invention is illustrated in FIGS. 4, 5 and 6, utilizing the same reference numerals. This embodiment also includes identical frame members 18, 19, 20, hinge plates 22 and 23, strike plate 24 and three bars 52, each bar somewhat longer than its corresponding hinge or strike plate.

Referring to FIGS. 4 and 5, frame members 18, 19 and 20 are as previously described, except that walls 45 and 47 do not define apertures 41 and 43. The hinges 22, 23, strike plate 24 and cover sections 68 are constructed as previously described.

In this embodiment, bar 52 does not include tongues 53 and 54 to mate with apertures 45 and 47. In addition, as particularly illustrated in FIG. 6, bar 52 is outwardly bent at the central portion of its length, but is otherwise constructed as described above. The hinge plates, strike plates, bars and cover plates are installed as described to complete the frame assembly.

For both embodiments, frame members 18, 19 and 20 can be cut from a single piece of stock extrusion at the construction site to fit the particular door opening 14 in wall 16. Hinges 22, 23 and strike plate 24, together with bars 52, can be installed where desired on the frame members. After installation of the hinge (22, 23) and strike (24) plates, cover plate sections 68 are cut to fit the spaces between the hinges and strike plate and ends of the frame member. The mechanisms of attachment of the plates to the frame member and the bars are completely hidden from view. Both sides of the frame members 18–20 with equipment attached appear identical, and the completed assembly forms a sturdy, aesthetically pleasing structure.

The provision of bars 52 attached to the frame member, with slots 56 on their outer surface, together with tongues 67 and 83 of the hinge and strike plates, respectively, projecting normal to the remaining tongues of the hinge and strike plates promotes the stability of the entire assembly by minimizing the tendency of the hinge plates, in particular, to detach from the frame member under stress. Bars 52, when they are outwardly bent at the center exert outward pressure on the hinge and strike plates to minimize the tendency of the hinge and strike plates to rattle.

While two specific embodiments of the present invention have been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. Apparatus for constructing a door frame in an opening formed in a wall to accommodate a door, said apparatus comprising:

a frame member including a central web adapted to span the width of the wall and a pair of side flanges extending from the lateral edges of the web and adapted to fit over the edges of the wall circumscribing the opening, said web including a pair of grooves opening in a common transverse direction, one said groove located proximate the center of said web and the other said groove located proximate one lateral edge of the web, the web further including a longitudinally-extending recess between said grooves;

at least two hinge members each having a hinge plate which includes a set of elongate tongues adapted to engage and mate with the respective grooves in the frame member and a separate elongate tongue projecting normal to the remaining tongues into the recess of the frame member;

at least two bars slidable in the recess of the frame member, said bars each defining a longitudinally-extending slot on the outer surface thereof to engage the separate elongate tongue of the respective hinge member when the bars are moved into position beneath the hinge members; and a plurality of cover plate sections each including a pair of elongate tongues adapted to engage and mate with the respective grooves in the frame member, said cover plate sections adapted to be cut to fit the gaps between hinge plates and the ends of the frame member so that the space between the hinge plates is covered, to provide a sturdy, aesthetically pleasing door frame.

2. Apparatus according to claim 1 and wherein the sides of the recess in the frame member each define a longitudinally-extending aperture and the bar includes longitudinally-extending tongues adapted to engage and mate with said apertures.

3. Apparatus according to claim 1 and additionally comprising a strike plate having a pair of elongate tongues adapted to engage and mate with the respective grooves in the frame member and a separate elongate tongue projecting normal to the remaining tongues into the recess of the frame member, and another bar slidable in the recess of the frame member and defining a longitudinally-extending slot on the outer surface thereof to engage the separate elongate tongue of the strike plate when the bar is moved into a position beneath the strike plate, and wherein said cover plate sections are cut to fit around the strike plate.

4. Apparatus according to claim 1 and wherein said bars are outwardly bent sufficiently to exert outward pressure on the hinge plates and strike plates to minimize rattling thereof.

5. Apparatus according to claim 1 and wherein the inner surface of the recess of the frame member defines a longitudinally-extending indentation adapted to ease insertion of a fastener into the frame member for attachment of a bar to the frame member.

6. Apparatus according to claim 5 and wherein each bar is longer than its respective hinge plate to allow insertion of a fastener at one end thereof after installation of a hinge plate over the bar.

7. In an apparatus for providing a door frame in an opening formed in a wall to accommodate a door, said apparatus comprising (i) a frame member including a central web adapted to span the width of the wall and a pair of side flanges extending from the lateral edges of the web and adapted to fit over the edges of the wall circumscribing the opening, said web including a planar section extending from one lateral edge to approximately the center of the web and terminating in a first transversely opening groove in the plane of said planar portion, said web further including a second transversely opening groove proximate the second lateral edge and parallel to the first groove but offset therefrom toward the wall, (ii) at least two hinge members each having a planar hinge plate which includes one edge providing a tongue adapted to engage and mate with the first groove in the frame member and a projecting tongue underlying the hinge plate and adapted to engage the second groove in the frame member so that the hinge members can be located where desired and attached to the frame member after installation of the frame member in the opening, and (iii) a plurality of cover plate sections each including a generally planar portion having a lateral edge providing a tongue adapted to mate with and engage the first groove in the frame member and a projecting tongue underlying the planar portion and adapted to engage the second groove in the frame member, said cover plate sections adapted to be cut to fit the gaps betweenn hinge plates, and the ends of the frame member so that the space between hinge plates is covered, the improvement which comprises:

(a) in the frame member, a longitudinally-extending recess between said grooves, the side walls of the recess defining longitudinally extending apertures;

(b) in the hinge plates, a separate elongate tongue extending from the inner side of the planar portion projecting normal to the other tongues into the recess of the frame member; and (c) at least two bars slidable within said recess, each bar including elongate tongues extending from the sides thereof to engage and mate with the apertures of the frame member and defining a longitudinally-extending slot onthe outer surface thereof to engage the separate elongate tongue of the respective hinge member when the bars are moved into position beneath the hinge members to minimize the tendency of the hinge plates to detach from the frame member.

8. The improvement according to claim 7 wherein the apparatus further comprises a strike plate including a generally planar portion having one edge providing a tongue adapted to mate with and engage the first groove in the frame member and a projecting tongue underlying the planar portion and adapted to engage the second groove in the frame member, and wherein the improvement further comprises;

(a) in the strike plate, a separate elongate tongue extending from the inner side of the planar portion and projecting normal to the other tongues into the recess of the frame member; and (b) another bar slidable within said recess including elongate tongues extending from the sides thereof to engage and mate with the apertures of the frame member and defining a longitudinally-extending slot on the outer surface thereof to engage the separate elongate tongue of the strike plate when the bar is moved into position beneath the strike plate.

9. The improvement according to claim 7, wherein the improvement further comprises a longitudinally extending indentation defined by the inner wall of the recess of the frame member to ease insertion of a fastener into the frame member to attach a bar to the frame member.

10. In an apparatus for providing a door frame in an opening formed in a wall to accommodate a door, said apparatus comprising (i) a frame member including a central web adapted to span the width of the wall and a pair of side flanges extending from the lateral edges of the web and adapted to fit over the edges of the wall circumscribing the opening, said web including a planar section extending from one lateral edge to approximately the center of the web and terminating in a first transversely opening groove in the plane of said planar portion, said web further including a second transversely opening groove proximate the second lateral edge and parallel to the first groove but offset therefrom toward the wall; (ii) at least two hinge members each having a planar hinge plate which includes one edge providing a tongue adapted to engage and mate with the first groove in the frame member and a projecting tongue underlying the hinge plate and adapted to engage the second groove in the frame member so that the hinge members can be located where desired and attached to the frame member after installation of the frame member in the opening; and (iii) a plurality of cover plate sections each including a generally planar portion having a lateral edge providing a tongue adapted to mate with and engage the first groove in the frame member and a projecting tongue underlying the planar portion and adapted to engage the second groove in the frame member, said cover plate sections adapted to be cut to fit the gaps between hinge plates and the ends of the frame member so that the space between hinge plates is covered, the improvement which comprises:

(a) in the frame member, a longitudinally-extending recess between said grooves;

(b) in the hinge plates, an elongate tongue extending from the inner side of the planar portion projecting normal to the other tongues into the recess of the frame member; and (c) at least two bars slidable within said recess, each bar defining a longitudinally-extending slot on the outer surface thereof to engage the separate elongate tongue of the respective hinge member when the bars are moved into position beneath the hinge members, the bars being outwardly bent sufficiently to exert outward pressure on a hinge plate installed above it to minimize rattling of the hinge plates.

11. The improvement according to claim 10 wherein the apparatus further includes a strike plate including a generally planar portion having one edge providing a tongue adapted to mate with and engage the first groove in the frame member and a projecting tongue underlying the planar portion and adapted to engage the second groove in the frame member, and wherein the improvement comprises;

(a) in the strike plate, a separate elongate tongue on the inner side of the planar portion projecting normal to the other tongues into the recess of the frame member; and (b) another bar slidable within said recess defining a longitudinally-extending slot on the outer surface thereof to engage the separate elongate tongue of the strike plate when the bar is moved into position beneath the strike plate, and being outwardly bent sufficiently to exert outward pressure on the strike plate installed above it to minimize rattling of the strike plate.

12. The improvement according to claim 10 and wherein the improvement further comprises a longitudinally extending indentation defined by the inner wall of the recess in the frame member to ease insertion of a fastener into the frame member to fasten a bar to the frame member.

* * * * *